US005778699A

United States Patent [19]

Darredeau

[11] Patent Number: 5,778,699

[45] Date of Patent: Jul. 14, 1998

[54] PROCESS AND INSTALLATION FOR THE PRODUCTION OF ARGON BY CRYOGENIC DISTILLATION

[75] Inventor: Bernard Darredeau, Sartrouville, France

[73] Assignee: L'Air Liquide, Societe Anonyme Pour L'Etude et L'Exploitation des Procedes Georges Claude, Paris Cedex, France

[21] Appl. No.: 858,462

[22] Filed: May 19, 1997

Related U.S. Application Data

[63] Continuation of Ser. No. 715,878, Sep. 19, 1996, abandoned.

[51] Int. Cl.[6] ..... F25B 1/00

[52] U.S. Cl. ..... 62/653; 62/924

[58] Field of Search ..... 62/653, 924

[56] References Cited

U.S. PATENT DOCUMENTS

| | | | |
|---|---|---|---|
| 1,880,981 | 10/1932 | Pollitzer et al. . | |
| 4,715,874 | 12/1987 | Erickson | 62/924 |
| 4,781,739 | 11/1988 | Erickson . | |
| 4,977,746 | 12/1990 | Grenier et al. | 62/924 |
| 5,311,744 | 5/1994 | Sweeney et al. . | |
| 5,426,946 | 6/1995 | Corduan et al. . | |
| 5,505,051 | 4/1996 | Darredeau et al. | 62/924 |
| 5,582,031 | 12/1996 | Rathbone | 62/653 |
| 5,590,544 | 1/1997 | Corduan et al. | 62/656 |

*Primary Examiner*—Ronald C. Capossela

*Attorney, Agent, or Firm*—Young & Thompson

[57] ABSTRACT

An installation for the production of argon comprising a double column (1, 3) and an argon purification column (5). An auxiliary column (9) serves to effect the nitrogen-oxygen separation, and is supplied by a stream from the low pressure column (3). Therefore, nitrogen does not contaminate the stream sent to the argon purification column (5).

17 Claims, 1 Drawing Sheet

PROCESS AND INSTALLATION FOR THE PRODUCTION OF ARGON BY CRYOGENIC DISTILLATION

Figure 1:
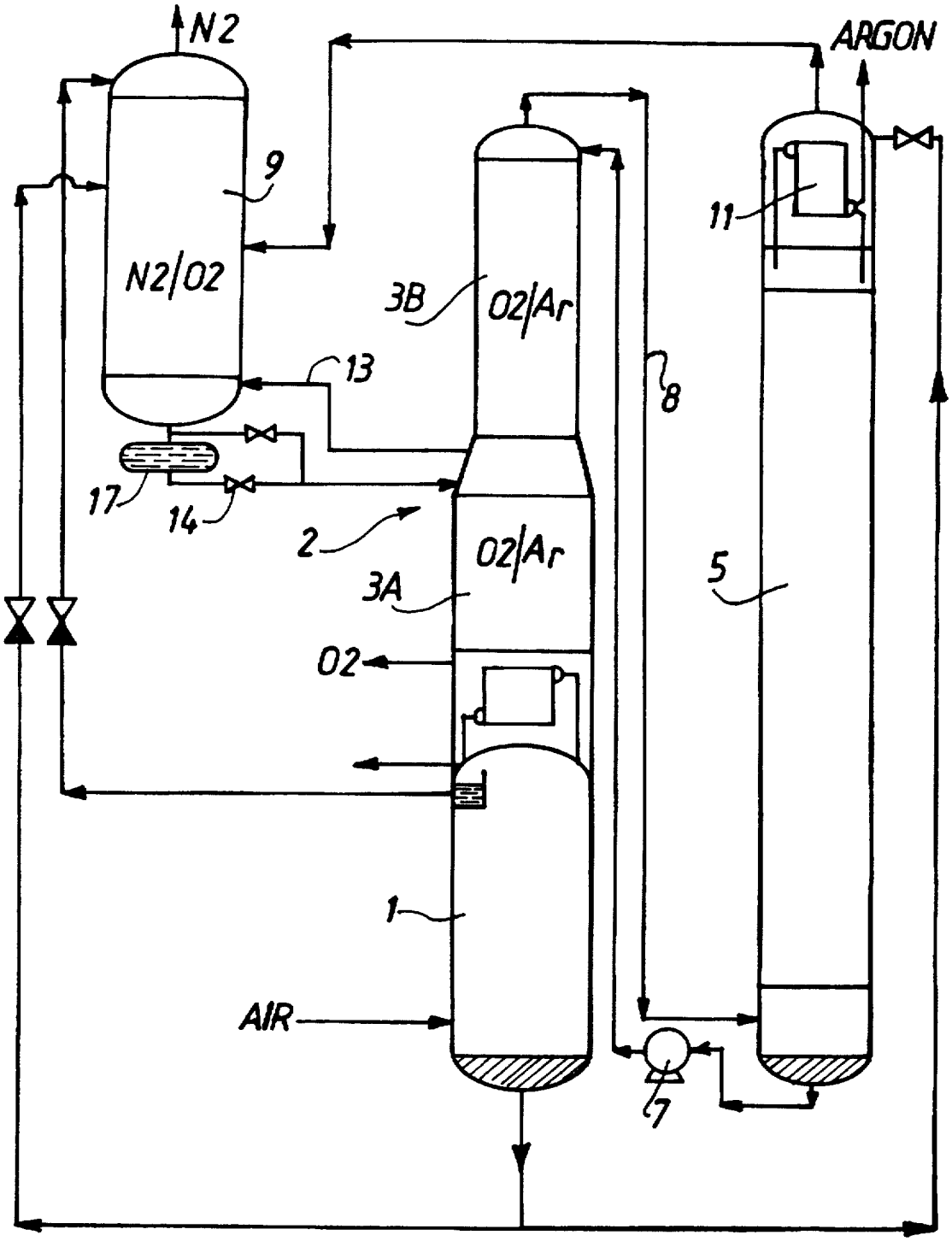

This application is a continuation of application Ser. No. 08/715,878, filed Sep. 19, 1996, now abandoned.

The present invention relates to a process and installation for the production of argon by cryogenic distillation and in particular such a process and such an installation in which a stream of air is distilled in a double column and a fraction rich in argon is withdrawn from the double column to produce gaseous argon.

Using the technology of structured packings, it is possible to produce argon with very low concentrations of oxygen and nitrogen by cryogenic means alone, the number of theoretical plates of the argon column being about 150. The procedure of this type is described in EP-A-0 377 117. However, the height of the argon column needed to carry out such a procedure is very great.

It is therefore natural that one skilled in the art would seek to reduce the height of the argon column by divided it into two sections. This arrangement, described in EP-A-0 628 777 and in J63-307762, provides a first section (so-called "mixture column") of the argon column supplied directly by the fraction rich in argon withdrawn from a low pressure column and a second section which purifies the mixture rich in argon from the first section.

Although this arrangement solves the problem of the excessive height of the one-piece argon column, careful study of this solution shows that it has drawbacks as to operation: thus, if the lower portion of the low pressure argon column is considered (below the withdrawal of the fraction rich in argon), it will be seen that it carries out a portion of the argon-oxygen separation (between 99.5% and 90% oxygen) and that the nitrogen is practically absent. The upper portion of this same low pressure column carries out essentially a nitrogen-oxygen separation, which is to say that the nitrogen there is present in very large quantity. By contrast, the mixture column carries out an argon-oxygen distillation and nitrogen is present only in a very low quantity. Thus, it is necessary to confine the nitrogen above the lower portion of the low pressure column whilst it is abundantly present in the portion just above. If the nitrogen reaches the point of withdrawal of the fraction rich in argon toward the mixture column, it will greatly upset the operation of this latter: there is thus no means to retain the vapor rich in nitrogen and to prevent it from rising to the argon mixture column and to become concentrated in the argon.

The object of the present invention is to solve the problem of nitrogen contamination of the stream withdrawn from the low pressure column.

According to the invention, argon production is carried out by cryogenic distillation of air, comprising the steps of:

i) separating the air into a fraction enriched in nitrogen and a fraction enriched in oxygen in the medium pressure column of a double column;

ii) sending at least one part of the two fractions to an auxiliary column;

iii) withdrawing a stream rich in argon from the low pressure column and sending it to an argon purification column; and iv) producing pure argon at the head of the purification column, characterized in that it comprises the steps of:

v) sending a stream withdrawn at an intermediate level of the low pressure column to an auxiliary column; and vi) withdrawing said stream rich in argon at a level above the intermediate level.

An example of the operation of the invention will now be described with reference to the accompanying drawing which shows schematically an embodiment of an air distillation installation according to the invention.

A stream of air is compressed to $5.5\times10^5$ Pa by a compressor, cooled and sent to the medium pressure column 1 of a double column. In conventional manner, it is separated into a vapor rich in nitrogen and a liquid enriched in oxygen. The vapor rich in nitrogen is condensed at least partially at the head of the medium pressure column by heat transfer with the liquid at the base of the low pressure column 3. At least one portion of the head and base liquids is sent to an auxiliary column 9 in which nitrogen-oxygen separation takes place. The head liquid being sent to a level of the column 9 above the point of injection of the bottoms liquid. A gaseous stream rich in nitrogen is produced at the head of the column 9. The stream rich in oxygen is in the bottom of the column 3. The column 3 comprises two sections 3A, 3B, the upper section 3B having a reduced cross section relative to the lower section 3A.

The separation of argon and oxygen takes place in the upper section 3B so as to produce a gaseous stream rich in argon. This stream is withdrawn and, via the conduit 8, supplies an argon purification column 5 containing a structured packing and having a head condenser 11. The bottoms liquid of this argon purification column 5 is returned to the head of the column 3 via a pump 7 as reflux. The head condenser 11 is cooled by a portion of the bottoms liquid from the medium pressure column 1. This liquid vaporizes and is sent to an intermediate level of the auxiliary column 9.

A gas containing about 90% oxygen is withdrawn from the head of the section 3A via the conduit 13. It then supplies an auxiliary column 9 which serves to carry out the separation of nitrogen and oxygen and which operates at the same pressure as the column 3. A nitrogen stream is produced at the head of the column 9 and a liquid rich in oxygen is returned to the top of section 3A via the conduit 14 as reflux.

So as to retain or slow the dispatch of this liquid rich in oxygen, a store 17 can be connected to the base of the column 9 by the conduit 14. In this way, contamination of the contents of the low pressure column 3 by nitrogen contained in this liquid can be avoided. Thus, the storage capacity for a liquid which can be the bottom of the auxiliary column, results in supplying a liquid whose content depends on the liquid which is accumulated during its dwell in this store. If the content of the liquid arriving at the bottoms is abruptly polluted with nitrogen, the content of the liquid which leaves will be attenuated.

In this way, the section 3B plays the role of the lower part of a low pressure column because it contains only a small quantity of nitrogen, most of the nitrogen having been sent to the auxiliary column 9.

Conceivably the sections 3A and 3B could be constructed as separate columns, the stream containing 90% of oxygen being withdrawn from the head of the column (section) 3A and divided in two. A portion of the gas would be sent to the bottom of the column (section) 3B and the rest would be sent to the bottom of the auxiliary column 9. The bottoms liquid of the column 3B would be sent to the head of the column 3A as reflux.

What is claimed is:

1. In a process for the production of argon by cryogenic distillation of air, comprising the steps of:

i) separating air into a fraction enriched in nitrogen and a fraction enriched in oxygen in a medium pressure column of a double column;

ii) sending at least one portion of the two fractions to an auxiliary column;

iii) withdrawing a stream rich in argon from the low pressure column and sending it to an argon purification column;

iv) producing pure argon at the head of the purification column;

the improvement comprising the steps of:

v) sending a stream withdrawn from an intermediate level of the low pressure column to an auxiliary column;

vi) withdrawing said stream rich in argon from said low pressure column at a level above said intermediate level.

2. Process according to claim 1 in which said stream rich in argon is withdrawn entirely at the very top of the low pressure column.

3. Process according to claim 1 in which a portion of the bottoms liquid from the auxiliary column is stored in a storage.

4. Process according to claim 3 in which liquid from the bottom of the auxiliary column is sent to an intermediate level of the low pressure column.

5. Process according to claim 4 in which the liquid from the bottom of the auxiliary column is retarded in its passage toward the low pressure column.

6. Process according to claim 1 in which the stream withdrawn from the intermediate level is sent to a lower portion of the auxiliary column and gas is withdrawn from the head of said auxiliary column as product.

7. Process according to claim 1 in which the stream sent to the auxiliary column contains about 90% oxygen.

8. Process according to claim 1 in which the stream sent from the low pressure column to the purification column contains about 1 to 2% oxygen.

9. Process according to claim 1 in which reflux for the auxiliary column is supplied by liquid from the medium pressure column.

10. Process according to claim 1 wherein liquid from the base of the medium pressure column is vaporized in a condenser at the head of the argon purification column and is sent to an intermediate level of the auxiliary column.

11. In an installation for the production of argon by cryogenic distillation of air comprising:

a double column comprising a medium pressure column thermally connected to a low pressure column;

an argon purification column;

means to send a stream rich in argon from a withdrawal point of the low pressure column to the argon purification column;

the improvement wherein the installation further comprises:

an auxiliary column;

means to send a stream withdrawn from an intermediate level of the low pressure column to the auxiliary column;

the means to send the stream enriched in argon to the purification column being connected at a level above said intermediate level.

12. Installation according to claim 11 in which the point of withdrawal of the stream enriched in argon is at the head of the low pressure column.

13. Installation according to claim 11 in which the means to send the stream withdrawn at an intermediate level of the low pressure column is connected to the lower portion of the auxiliary column.

14. Installation according to claim 11 in which means connect the bottom of the auxiliary column and an intermediate portion of the low pressure column.

15. Installation according to claim 14 comprising means to retard the flow of liquid from the base of the auxiliary column toward the low pressure column.

16. Installation according to claim 11 in which a store of liquid receives liquid from the lower portion of the auxiliary column.

17. Installation according to claim 11 in which means for withdrawing nitrogen purified from heavy impurities are connected to the head of the auxiliary column.

* * * * *

UNITED STATES PATENT AND TRADEMARK OFFICE

CERTIFICATE OF CORRECTION

PATENT NO. : 5,778,699

DATED : July 14, 1998

INVENTOR(S) : Bernard DARREDEAU

It is certified that error appears in the above-indentified patent and that said Letters Patent is hereby corrected as shown below:

On the title page, insert Item [30] as follows:

--[30] Foreign Application Priority Data

September 29, 1995 [FR] France.....95 11473--.

Signed and Sealed this

Third Day of November, 1998

*Attest:*

*Attesting Officer*

Bruce Lehman

BRUCE LEHMAN

*Commissioner of Patents and Trademarks*